US009228771B2

(12) United States Patent
Kamitani et al.

(10) Patent No.: US 9,228,771 B2
(45) Date of Patent: Jan. 5, 2016

(54) OUTDOOR UNIT FOR AIR CONDITIONING DEVICE

(71) Applicant: DAIKIN INDUSTRIES, LTD., Osaka-shi, Osaka (JP)

(72) Inventors: Shigeki Kamitani, Sakai (JP); Mikio Kagawa, Sakai (JP); Fumiaki Koike, Sakai (JP); Hiroshi Fuchikami, Sakai (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 14/344,722

(22) PCT Filed: Sep. 28, 2012

(86) PCT No.: PCT/JP2012/075021

§ 371 (c)(1),
(2) Date: Mar. 13, 2014

(87) PCT Pub. No.: WO2013/047721

PCT Pub. Date: Apr. 4, 2013

(65) Prior Publication Data

US 2014/0326437 A1 Nov. 6, 2014

(30) Foreign Application Priority Data

Sep. 29, 2011 (JP) ..... 2011-215047

(51) Int. Cl.

| | |
|---|---|
| ***F25D 17/06*** | (2006.01) |
| ***F24F 1/22*** | (2011.01) |
| ***F24F 1/24*** | (2011.01) |
| ***F25B 1/00*** | (2006.01) |
| *F24F 1/38* | (2011.01) |
| *F25B 13/00* | (2006.01) |

(52) U.S. Cl.
CPC . *F25D 17/06* (2013.01); *F24F 1/22* (2013.01); *F24F 1/24* (2013.01); *F25B 1/005* (2013.01); *F24F 1/38* (2013.01); *F25B 13/00* (2013.01); *F25B 2313/0233* (2013.01)

(58) Field of Classification Search
CPC ..... F24F 1/38; F24F 1/22; F24F 1/24
USPC ..... 62/259.2, 428, 506, 507, 508, DIG. 16
See application file for complete search history.

(56) References Cited

U.S. PATENT DOCUMENTS

| | | | | |
|---|---|---|---|---|
| 4,723,419 | A * | 2/1988 | Kessler et al. | 62/507 |
| 2009/0133423 | A1 * | 5/2009 | Jang et al. | 62/259.2 |
| 2014/0047857 | A1 * | 2/2014 | Sao et al. | 62/259.2 |

FOREIGN PATENT DOCUMENTS

| | | | | |
|---|---|---|---|---|
| EP | 1 684 022 | A1 | 7/2006 | |
| JP | 2000161717 | A * | 6/2000 | F24F 5/00 |

(Continued)

*Primary Examiner* — Cheryl J Tyler
*Assistant Examiner* — Elizabeth Martin
(74) *Attorney, Agent, or Firm* — Birch, Stewart, Kolasch & Birch, LLP

(57) ABSTRACT

An outdoor unit for an air conditioning device includes an outdoor unit main body, a heat exchanger, a fan provided in an upper part of the outdoor unit main body, the fan blowing out the air taken in from a side surface of the outdoor unit main body upward, a ventilating member surrounding an outer circumference of the fan and forming a blow-out port, and an electric component unit accommodated in the outdoor unit main body and arranged in an opening portion between one side end portion and the other side end portion of the heat exchanger, wherein the electric component unit is provided so as to cross over a lower end of the ventilating member in the up and down direction, and on the upper side than the lower end of the ventilating member, the electric component unit is arranged on the horizontally outer side than the ventilating member.

6 Claims, 12 Drawing Sheets

(56) References Cited

FOREIGN PATENT DOCUMENTS

| | | | | |
|---|---|---|---|---|
| JP | 2004-156872 | A | | 6/2004 |
| JP | 2007-198684 | A | | 8/2007 |
| JP | 2008-128496 | A | | 6/2008 |
| JP | 2009-079870 | A | | 4/2009 |
| JP | 2011007407 | A | * | 1/2011 |
| JP | 2011-99577 | A | | 5/2011 |
| JP | 2011-137610 | A | | 7/2011 |
| JP | 2011-153806 | A | | 8/2011 |
| JP | 2011220654 | A | * | 11/2011 |
| JP | 2013015318 | A | * | 1/2013 |

* cited by examiner

OUTDOOR UNIT FOR AIR CONDITIONING DEVICE

TECHNICAL FIELD

The present invention relates to an outdoor unit for an air conditioning device.

BACKGROUND ART

Patent Literature 1 described below discloses an upward blowing type outdoor unit that blows out the air taken into an interior from a side surface of an outdoor unit main body (casing) upward by driving a fan provided on an upper part of the outdoor unit main body. In this outdoor unit, a heat exchanger formed into a U shape in a plan view is provided so as to face three side surfaces of the substantially cubic outdoor unit main body. In an opening portion formed between one side end portion and the other side end portion of the heat exchanger, a control box (electric component unit) is arranged so as to face the remaining one side surface of the outdoor unit main body.

CITATION LIST

Patent Literature

Patent Literature 1: Japanese Unexamined Patent Publication No. 2004-156872

SUMMARY OF INVENTION

Technical Problem

In this type of outdoor unit, downsizing while maintaining a heat exchange ability and an increase in the heat exchange ability without a size increase are desired. Therefore, it is thought that the heat exchanger is extended so as to face not only three side surfaces of the outdoor unit main body but four side surfaces.

However, when a range of the heat exchanger is extended, the opening portion between the one side end portion and the other side end portion of the heat exchanger is reduced, and a ratio of an arrangement space of the control box in the opening portion is increased. The opening portion is utilized not only for arranging the control box but also for performing maintenance and replacement of devices accommodated in the outdoor unit main body. Thus, when the ratio of the arrangement space of the control box in the opening portion is increased, workability of the maintenance and the like is not easily ensured. Even in a case where the range of the heat exchanger is not extended, reduction in the ratio of the arrangement space of the control box in the opening portion is effective for enhancing the workability of the maintenance and the like.

The present invention is achieved in consideration with the situation described above, and an object thereof is to provide an outdoor unit for an air conditioning device capable of reducing a ratio of an arrangement space of an electric component unit in an opening portion between one side end portion and the other side end portion of a heat exchanger as far as possible, so as to ensure workability of maintenance and the like of devices in an outdoor unit main body.

Solution to Problem (1) An outdoor unit for an air conditioning device according to the present invention includes an outdoor unit main body, a heat exchanger accommodated in the outdoor unit main body, a fan provided in an upper part of the outdoor unit main body, the fan blowing out air suctioned from side surfaces of the outdoor unit main body upward, a ventilating member surrounding an outer circumference of the fan and forming a blow-out port of the air, and an electric component unit accommodated in the outdoor unit main body and arranged in an opening portion between one side end portion and the other side end portion of the heat exchanger, wherein the electric component unit is provided so as to cross over a lower end of the ventilating member in the up and down direction, and a part of the electric component unit arranged on the upper side than the lower end of the ventilating member is arranged on the horizontally outer side than the ventilating member.

In an upward blowing type outdoor unit including a fan in an upper part of an outdoor unit main body, there is often a case where a part on the horizontally outer side than a ventilating member surrounding an outer circumference of the fan hardly contributes to a flow of the air, serving as a so-called dead space. Therefore, in the outdoor unit of the present invention, by arranging a part of the electric component unit in the dead space, a ratio of an arrangement space of the electric component unit in the opening portion between the one side end portion and the other side end portion of the heat exchanger on the lower side than the ventilating member is reduced. Thereby, the opening portion can be utilized as widely as possible for a work such as maintenance and replacement of devices in the outdoor unit main body, so that workability of the work can be improved. The part of the electric component unit hardly influences the flow of the air on the upper side than the lower end of the ventilating member, so that heat exchange efficiency is not deteriorated.

(2) Preferably, the outdoor unit main body is formed into a square shape in a plan view, and the heat exchanger is provided so as to face four side surfaces of the outdoor unit main body.

In such a way, since the heat exchanger is arranged so as to face the four side surfaces of the outdoor unit main body, the outdoor unit can be compactified while maintaining a heat exchange ability, or the heat exchange ability can be increased without increasing size of the outdoor unit. Furthermore, since the ratio of the arrangement space of the electric component unit in the opening portion can be reduced as described above, the workability of the work such as the maintenance performed via the opening portion is not deteriorated.

(3) Preferably, the heat exchanger is provided so as to face the four side surfaces in a range excluding one corner portion of the outdoor unit main body, and the electric component unit is arranged in the corner portion.

The fan provided in the upper part of the outdoor unit main body is rotated while leaving a circular trajectory in a plan view, and the ventilating member surrounding the outer circumference of this fan is formed into a cylindrical shape. Therefore, in the corner portion of the outdoor unit main body formed into a square shape in a plan view on the horizontally outer side of the ventilating member, a relatively wide dead space is generated. In the present invention, by utilizing such a corner portion, an arrangement space of a part of the electric component unit, can be ensured as widely as possible in a planar range of the outdoor unit main body.

(4) Preferably, the fan is arranged in such a manner that center thereof is displaced to the side of other corner portions of the outdoor unit main body in a planar range of the outdoor unit main body.

With such a configuration, the arrangement space of the electric component unit can be more widely ensured in the one corner portion of the outdoor unit main body on the horizontally outer side of the ventilating member, and the fan can be arranged closely to a part of the heat exchanger where a circulation area of the air is large, so that the heat exchange efficiency can be improved.

(5) Preferably, a space with which the compressor is taken in and out is formed between the electric component unit and the one side end portion of the heat exchanger.

With such a configuration, the replacement and the maintenance of the heat exchanger can be easily performed.

(6) Preferably, the electric component unit is supported by a beam member arranged in the horizontal direction corresponding to one of the side surfaces of the outdoor unit main body, and the beam member has a guide rail portion for, at the time of attaching the electric component unit to a predetermined attachment point of the outdoor unit main body, guiding the electric component unit to the attachment point.

With such a configuration, the electric component unit can be promptly and readily positioned at a proper attachment point in the outdoor unit main body.

(7) Preferably, the electric component unit includes an electric component box for accommodating an electric component, and in the electric component box, a first intake port for taking the air into the electric component box is formed on the upper side than the lower end of the ventilating member, and an discharge port for discharging the air in the electric component box is formed on the lower side than the lower end of the ventilating member.

In an interior of the outdoor unit main body, in a region on the lower side than the lower end of the ventilating member, pressure becomes negative pressure by actuation of the fan. Meanwhile, in a region on the upper side than the lower end of the ventilating member and on the horizontally outer side than the ventilating member, a suctioning action of the fan is not exerted and the pressure becomes positive pressure or atmospheric pressure. Therefore, by differential pressure between both the regions, a flow of the air flowing to an interior of the electric component box from the first intake port and being discharged to an exterior of the electric component box from the discharge port is formed, so that a heat release property in the electric component box is enhanced.

(8) Preferably, a second intake port for taking the air into the electric component box is formed on the lower side than the discharge port in a lower portion of the electric component box.

Since both the discharge port and the second intake port are arranged in the region on the lower side than the lower end of the ventilating member, vicinity parts thereof are in a negative pressure state. In particular, since the vicinity part of the discharge port is closer to the fan than the vicinity part of the second intake port, the pressure is lower. Therefore, by differential pressure between both the parts, a flow of the air flowing to the interior of the electric component box from the second intake port and being discharged to the exterior of the electric component box from the discharge port is formed. As described above, a relatively strong flow of the air coming from the first intake port on the positive pressure side to the discharge port on the negative pressure side is generated in the electric component box. Thus, by this flow, the flow of the air from the second intake port to the discharge port is facilitated. Therefore, the heat release property in the electric component box can be more enhanced.

(9) Preferably, a high heat generating part is arranged in the lower portion of the electric component box.

With such a configuration, the high heat generating part can be cooled down by the air taken from the second intake port in the lower portion of the electric component box. It should be noted that as the high heat generating part, there are electric parts including a power module having a power element such as an IGBT for driving a motor of the compressor or the fan, a reactor, and the like.

(10) Preferably, an arrangement recess portion for arranging a cooling refrigerant pipe for cooling down the high heat generating part in the planar range of the electric component box is formed in the lower portion of the electric component box.

With such a configuration, the high heat generating part arranged in the lower portion of the electric component box can be effectively cooled down by a refrigerant flowing through the cooling refrigerant pipe. Since the cooling refrigerant pipe is arranged in the arrangement recess portion formed in the electric component box, the cooling refrigerant pipe does not protrude from the planar range of the electric component box, so that the electric component box including the cooling refrigerant pipe can be arranged in a small planar space.

(11) Preferably, the arrangement recess portion is formed by recessing a part of a bottom wall of the electric component box upward, and an electric wire in the electric component box is pulled out to an exterior from a bottom wall in the arrangement recess portion.

With such a configuration, the electric wire can be pulled out to the exterior without passing through the lower portion of the electric component box where the high heat generating part is arranged. Thereby, noises of the high heat generating part can be prevented from influencing the electric wire.

Advantageous Effects of Invention

According to the present invention, the ratio of the arrangement space of the electric component unit in the opening portion between the one side end portion and the other side end portion of the heat exchanger can be reduced as far as possible, and the opening portion can be widely used for the work such as the maintenance of the devices in the outdoor unit main body, so that the workability of the work can be improved.

DESCRIPTION OF EMBODIMENTS

Figure 1:
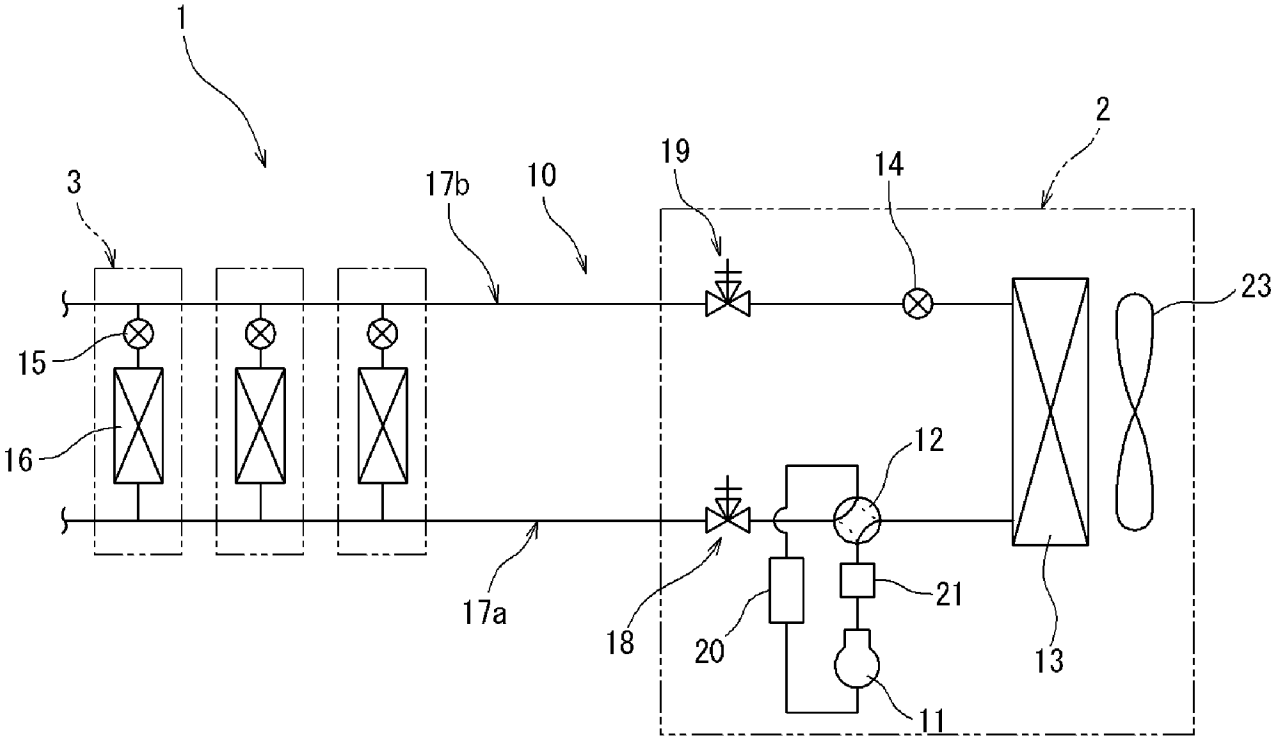
FIG. 1 is a schematic view showing a refrigerant circuit of an air conditioning device having an outdoor unit according to a first embodiment of the present invention.

FIG. 1 is a schematic view showing a refrigerant circuit of an air conditioning device having an outdoor unit according to a first embodiment of the present invention.

An air conditioning device 1 is for example a multiple type air conditioning device for a building in which a refrigerant circuit 10 is formed in such a manner that a plurality of indoor units 3 is connected in parallel to one or a plurality of outdoor unit 2 so as to circulate a refrigerant.

In the outdoor unit 2, a compressor 11, a four way valve 12, an outdoor heat exchanger 13, an outdoor expansion valve 14, an accumulator 20, an oil separator 21, and the like are provided. These are connected by a refrigerant pipe. In the outdoor unit 2, a fan 23 is provided. In the indoor unit 3, an indoor expansion valve 15, an indoor heat exchanger 16, and the like are provided. The four way valve 12 and the indoor heat exchanger 16 are connected by a gas side refrigerant communication tube 17*a*, and the outdoor expansion valve 14 and the indoor expansion valve 15 are connected by a liquid side refrigerant communication tube 17*b*. A gas side stop valve 18 and a liquid side stop valve 19 are provided in terminal portions of the inside refrigerant circuit of the outdoor unit 2. The gas side stop valve 18 is arranged on the side of the four way valve 12, and the liquid side stop valve 19 is arranged on the side of the outdoor expansion valve 14. The gas side refrigerant communication tube 17*a* is connected to the gas side stop valve 18, and the liquid side refrigerant communication tube 17*b* is connected to the liquid side stop valve 19.

In a case where a cooling operation is performed in the air conditioning device 1 with the above configuration, the four way valve 12 is retained in a state shown by solid lines in FIG, 1. A high-temperature and high-pressure gas refrigerant discharged from the compressor 11 flows into the outdoor heat exchanger 13 via the oil separator 21 and the four way valve 12, and performs heat exchange with the outdoor air by actuation of the fan 23 so as to be condensed and liquefied. The liquefied refrigerant passes through the outdoor expansion valve 14 in a fully open state, and flows into the indoor units 3 through the liquid side refrigerant communication tube 17*b*. In the indoor unit 3, pressure of the refrigerant is reduced to predetermined low pressure by the indoor expansion valve 15, and further, the refrigerant performs the heat exchange with the indoor air in the indoor heat exchanger 16 so as to be evaporated. The indoor air cooled by evaporation of the refrigerant is blown out to an interior by an indoor fan (not shown) so as to cool the interior. The refrigerant evaporated and gasified in the indoor heat exchanger 16 is returned to the outdoor unit 2 through the gas side refrigerant communication tube 17*a*, and suctioned into the compressor 11 via the four way valve 12 and the accumulator 20.

On the other hand, in a case where a heating operation is performed, the four way valve 12 is retained in a state shown by broken lines in FIG. 1. A high-temperature and high-pressure gas refrigerant discharged from the compressor 11 flows into the indoor heat exchanger 16 of the indoor unit 3 via the oil separator 21 and the four way valve 12, and performs the heat exchange with the indoor air so as to be condensed and liquefied. The indoor air heated by condensation of the refrigerant is blown out to the interior by the indoor fan so as to heat the interior. The refrigerant liquefied in the indoor heat exchanger 16 is returned to the outdoor unit 2 from the indoor expansion valve 15 in a fully open state through the liquid side refrigerant communication tube 17*b*. The pressure of the refrigerant returned to the outdoor unit 2 is reduced to predetermined low pressure by the outdoor expansion valve 14, and further, the refrigerant performs the heat exchange with the outdoor air in the outdoor heat exchanger 13 so as to be evaporated. The refrigerant evaporated and gasified in the outdoor heat exchanger 13 is suctioned into the compressor 11 via the four way valve 12 and the accumulator 20.

Figure 2:
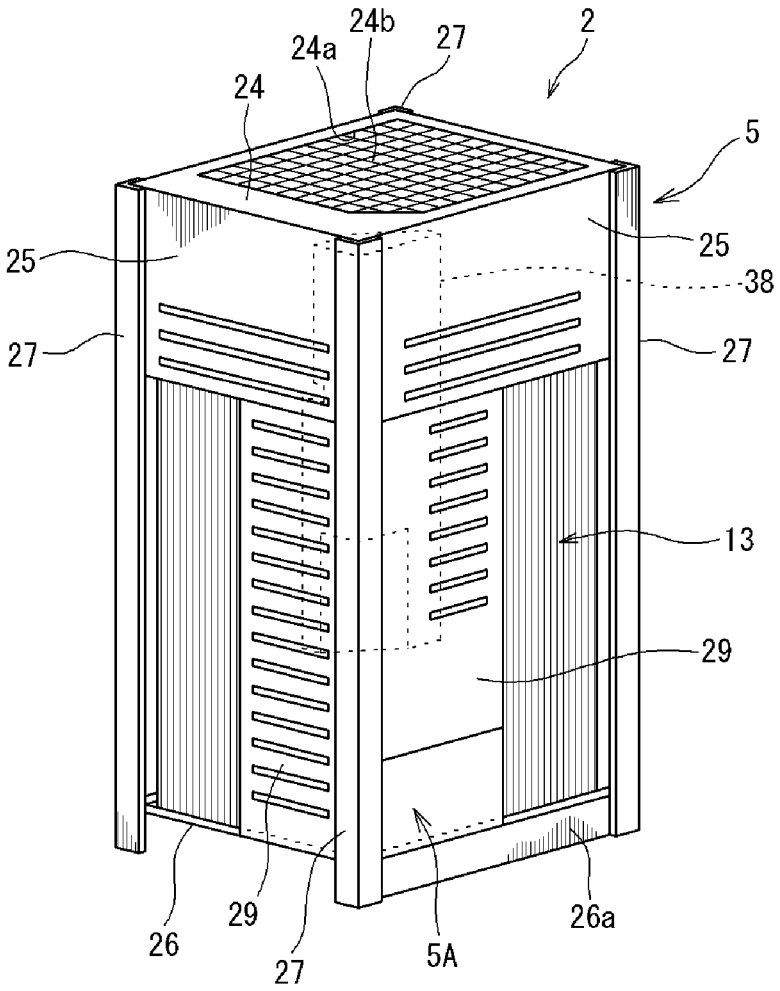
FIG. 2 is a perspective view showing an outer appearance of the outdoor unit.
Figure 3:
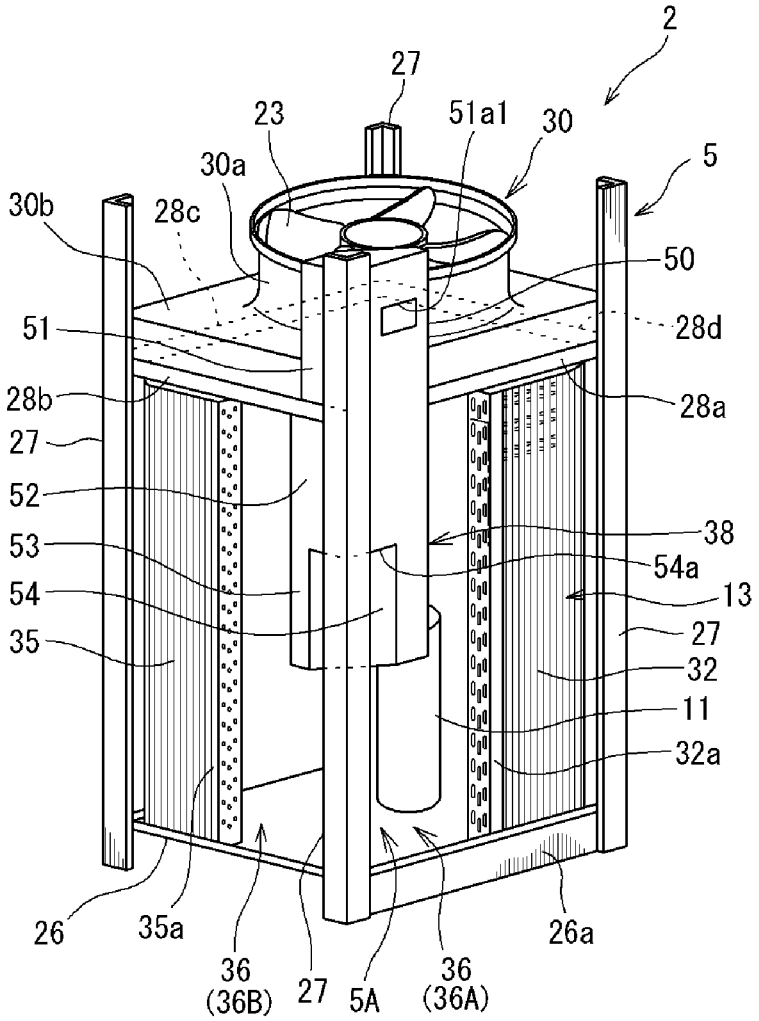
FIG. 3 is a schematic perspective view showing a state that side surface panels and a top plate of the outdoor unit are removed.
Figure 4:
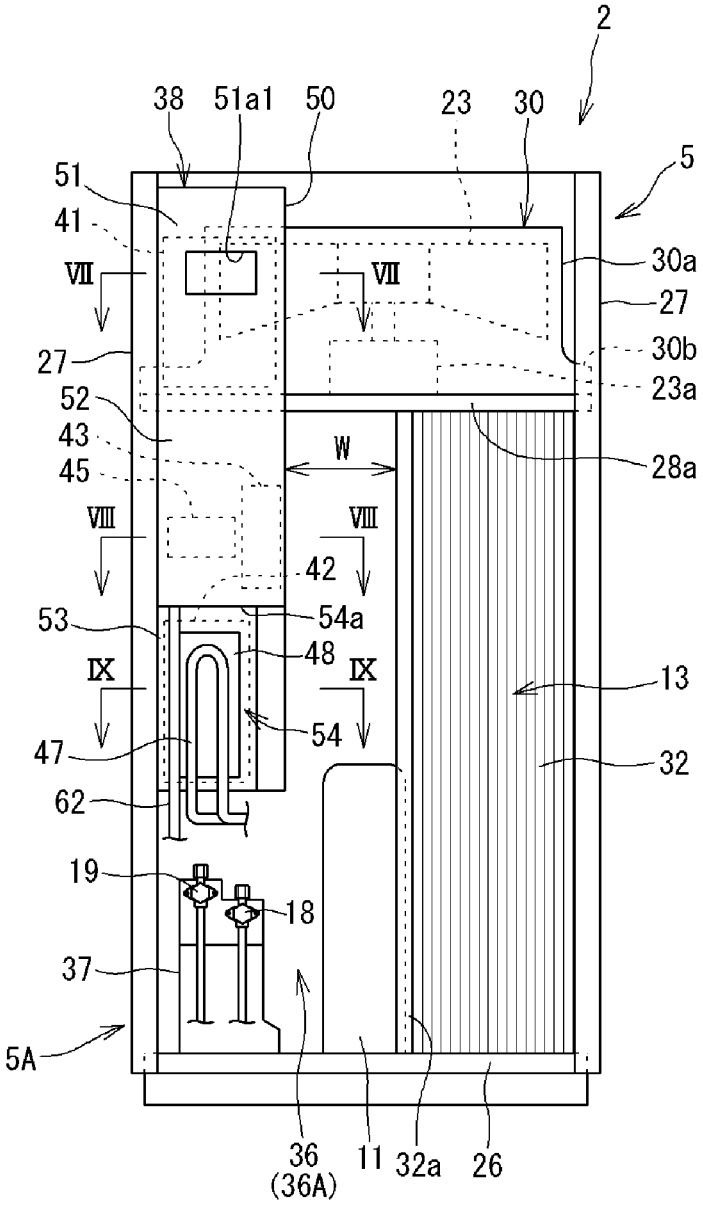
FIG. 4 is a schematic front view showing the state that the side surface panels and the top plate of the outdoor unit are removed.
Figure 5:
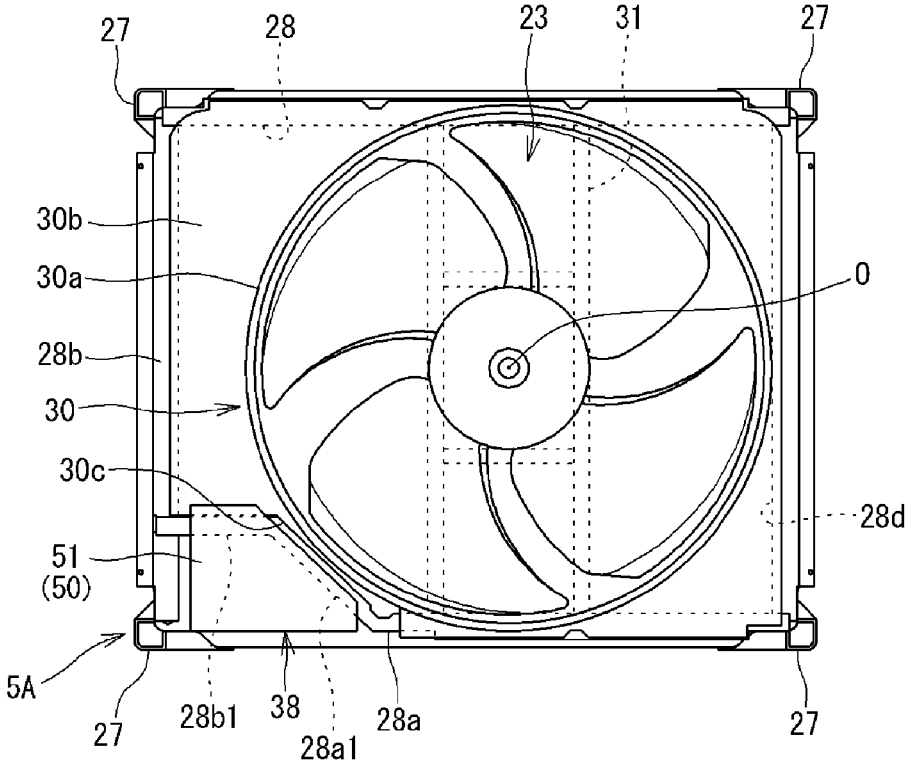
FIG. 5 is a plan view of the outdoor unit from which the top plate is removed.
Figure 6:
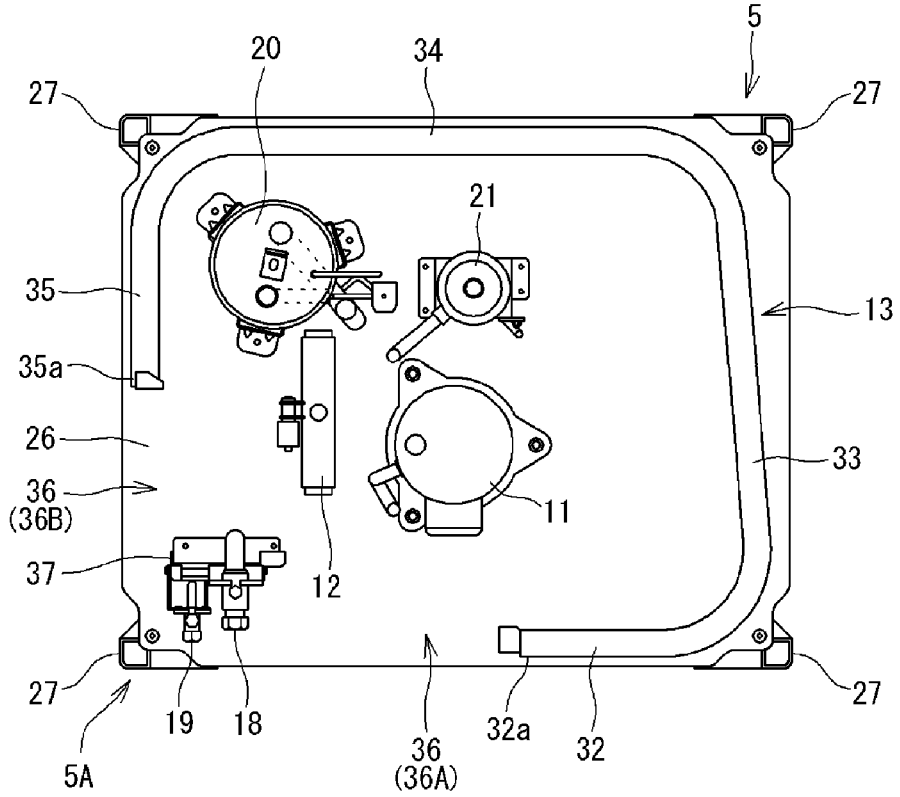
FIG. 6 is a plan view of an interior of the outdoor unit.

FIG. 2 is a perspective view of an outer appearance of the outdoor unit, FIG. 3 is a schematic perspective view showing a state that side surface panels and a top plate of the outdoor unit are removed, and FIG. 4 is a schematic front view showing the state that the side surface panels and the top plate of the outdoor unit are removed. FIG. 5 is a plan view of the outdoor unit from which the top plate is removed, and FIG. 6 is a plan view of an interior of the outdoor unit.

The outdoor unit 2 of the present embodiment is of an upward blowing type, and includes an outdoor unit main body (casing) 5, the devices forming the refrigerant circuit 10 (refer to FIG. 1) such as the outdoor heat exchanger 13 built in this outdoor unit main body 5, the compressor 11, the four way valve 12, the accumulator 20, and the oil separator 21, an electric component unit 38, and the fan 23 provided in an upper part of the outdoor unit main body 5.

The outdoor unit 2 suctions the air from side surfaces of the outdoor unit main body 5 by driving the fan 23, performs the heat exchange with the outdoor heat exchanger 13, and then blows out the air upward from the upper part of the outdoor unit main body 5.

As shown in FIG. 2 and FIG. 3, the outdoor unit main body 5 is formed into a substantially cubic shape, and has a bottom frame 26, support pillars 27, beam members 28*a* to 28*d*, lower side surface panels 29, upper side surface panels 25, a top plate 24, and the like. The bottom frame 26 is formed into a square shape in a plan view. Leg portions 26*a* connected to the ground are provided in two sides facing front and rear side parts of the bottom frame 26. The support pillars 27 are formed by a long member elongated in the up and down direction, the long member having a substantially L shape section, and attached to four corners of the bottom frame 26 by bolts or the like.

As shown in FIG. 2, the top plate 24 is formed into a square shape in a plan view which is the substantially same as the bottom frame 26, and arranged so as to have a gap above the bottom frame 26. Upper ends of the support pillars 27 are coupled to four corners of the top plate 24 by coupling tools such as bolts. A substantially square ventilating hole 24*a* is formed in the top plate 24, and a net body 24*b* for preventing invasion of foreign substances is provided in this ventilating hole 24*a*.

As shown in FIG. 3 and FIG. 5, the beam members 28*a* to 28*d* are arranged on the upper part side of the support pillars 27 at positions having a predetermined gap downward from the top plate 24, and bridged between the support pillars 27 adjacent to each other in the front and rear direction and the left and right direction. A framework of the outdoor unit main body 5 is formed by structural members including the bottom frame 26, the top plate 24, the support pillars 27, and the beam members 28*a* to 28*d*.

A bell mouth 30 is attached to the four beam members 28*a* to 28*d*. This bell mouth 30 has a ventilating guide (ventilating member) 30*a* surrounding an outer circumference part of the fan 23. The ventilating guide 30*a* is formed into a cylindrical shape along a circular rotation trajectory of the fan 23, to form a blow-out port of the air from the outdoor unit main body 5. A support base 31 (refer to FIG. 5) is bridged over the front and rear beam members 28*a* and 28*c*, and a motor 23*a* (refer to FIG. 4) of the fan 23 is attached to this support base 31. Therefore, the beam members 28*a* and 28*c* also function as attachment members for attaching the fan 23.

As shown in FIG. 2, the upper side surface panels 25 are provided on the four side surfaces of the outdoor unit main body 5 positioned between the beam members 28*a* to 28*d* and the top plate 24. The fan 23, the bell mouth 30, and an upper part of the electric component unit 38 are covered by the upper side surface panels 25 and the top plate 24 so as not to be exposed to an exterior.

As shown in FIG. 5, a rotation center 0 of the fan 23 is arranged in a substantially center part in the front and rear direction of the outdoor unit main body 5 at a position displaced slightly rightward from the center. As shown in FIG. 2, the ventilating hole 24*a* of the top plate 24 is arranged at a position displaced slightly rightward from the center to match with the fan 23. It should be noted that in the top plate 24, no ventilating hole 24*a* is formed at a position above the electric component unit 38 to be described later. Thereby, the electric component unit 38 is prevented from getting caught by rainwater and the like invading from the ventilating hole 24*a*.

As shown in FIG. 6, the devices such as the outdoor heat exchanger 13, the compressor 11, the accumulator 20, the oil separator 21, and the four way valve 12 are mounted on an upper surface of the bottom frame 26 of the outdoor unit main body 5. The outdoor heat exchanger 13 is of a cross fin coil type in which a heat transfer tube horizontally passes through a large number of aluminum fins and the heat exchange is performed between the refrigerant flowing through the heat transfer tube and the air circulated in the outdoor heat exchanger 13.

The outdoor heat exchanger 13 is bent in a substantially square shape so as to face (correspond to) the four side surfaces in a range excluding one corner portion (left front corner portion) 5A of the outdoor unit main body 5 along the four side surfaces. Specifically, the outdoor heat exchanger 13 has a front heat exchange portion 32 along the side surface on the front side of the outdoor unit main body 5 (front surface), a right heat exchange portion 33 along the side surface on the right side, a rear heat exchange portion 34 along the side surface on the rear side (rear surface), and a left heat exchange portion 35 along the side surface on the left side. A part between the front heat exchange portion 32 and the right heat exchange portion 33, a part between the right heat exchange portion 33 and the rear heat exchange portion 34, and a part between the rear heat exchange portion 34 and the left heat exchange portion 35 are bent at substantially 90 degrees. It should be noted that the heat exchange portions 32 to 35 of the outdoor heat exchanger 13 do not necessarily face the side surfaces of the outdoor unit main body 5 in parallel but may face the side surfaces in an inclined state. In the present specification, the side surfaces of the outdoor unit main body 5 may be actual side surfaces facing the exterior regulated by for example, the upper side surface panels 25 described above, the lower side surface panels 29 to be described later, or grid shape frames or panels covering outer side surfaces of the outdoor heat exchanger 13. In a case where such side surface panels 25 and 29 or the like are not provided, the side surfaces may be regulated by imaginary surfaces formed by extending four sides of the bottom frame 26 upward straightaway.

As shown in FIG. 6, a part between a left side end portion (one side end portion of the outdoor heat exchanger 13) 32*a* of the front heat exchange portion 32 and a front side end portion (other side end portion of the outdoor heat exchanger 13) 35*a* of the left heat exchange portion 35 serves as an opening portion 36. In the present embodiment, the opening portion 36 is divided into two by the support pillar 27 arranged on the left front side. In the following description, a part of the opening portion 36 arranged on a front surface of the outdoor unit 2 will be called a front opening portion 36A, and a part of the opening portion 36 arranged on a left side surface will be called a left opening portion 36B.

In the outdoor unit main body 5, the lower side surface panels 29 are respectively detachably provided between the one side end portion 32*a* and the support pillar 27 of the outdoor heat exchanger 13, and between this support pillar 27 and the other side end portion 35*a* of the outdoor heat exchanger 13 (refer to FIG. 2). The front opening portion 36A and the left opening portion 36B are respectively closed by the lower side surface panels 29. It should be noted that although not shown, a grid shape frame or panel through which the air is circulated may be attached to a part of the side surface of the outdoor unit main body 5 where the outdoor heat exchanger 13 is arranged.

As shown in FIG. 6, the stop valves 18 and 19 are supported via an attachment base 37 so as to face the front opening portion 36A of the outdoor unit main body 5. The compressor 11 is arranged closely to a right side part of the front opening portion 36A at such a position that the substantially entire compressor can be visually recognized from the front side via the front opening portion 36A. The accumulator 20 and the oil separator 21 on the bottom frame 26 are arranged on the rear part side in the outdoor unit main body 5.

As shown in FIG. 4, a width W of the front opening portion 36A formed between the electric component unit 38 to be described later and the one side end portion 32*a* of the outdoor heat exchanger 13 is set to be such a size that the compressor 11 can pass through. By utilizing this space for replacement or the like of the compressor 11, the compressor 11 can be taken in and out.

As shown in FIG. 4, the electric component unit 38 includes electric parts such as a control board 41 for controlling the entire outdoor unit 2, drive boards (inverter boards) 42 and 43 for driving the compressor 11 and the fan 23, a reactor 44 (refer to FIG. 7), a terminal base 45, and an electric component box 50 for accommodating these electric parts. As shown in FIG. 3, the electric component unit 38 is arranged corresponding to the one corner portion 5A in the outdoor unit main body 5, that is, the corner portion 5A of the outdoor unit main body 5 where the outdoor heat exchanger 13 is not arranged.

The electric component box 50 is provided in a range from a substantially upper end portion of the outdoor unit main body 5 to a part on the slightly lower side of an intermediate part in the up and down direction. Therefore, the electric component box 50 is arranged so as to cross over the beam members 28*a* to 28*d* and an upper end of the outdoor heat exchanger 13 in the up and down direction. The electric component box 50 is arranged so as to cross over a lower end of the cylindrical ventilating guide 30*a* in the bell mouth 30 in the up and down direction.

The electric component box 50 of the electric component unit 38 is attached to and supported on the support pillar 27 arranged in the corner portion 5A, the beam members 28*a* and 28*b* coupled to this support pillar 27 and the like by bolts or the like. The electric component box 50 includes an upper portion 51, an intermediate portion 52, and a lower portion 53 whose planar shapes are different from each other. The portions 51, 52 and 53 have the substantially same height.

Figure 7:
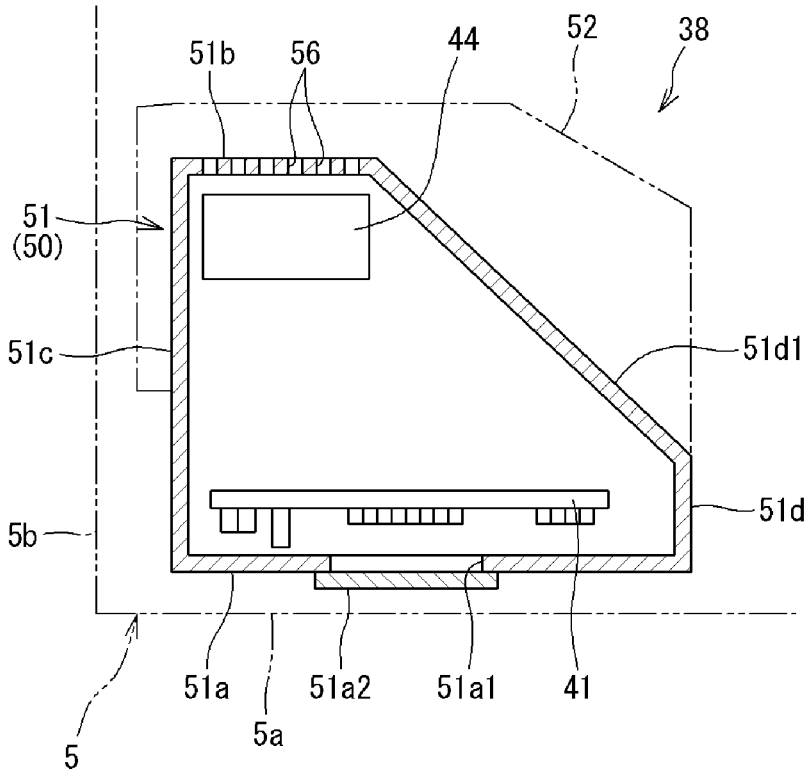
FIG. 7 is a schematic sectional view of an electric component box corresponding to a position of arrow VII-VII in FIG. 4.

The upper portion 51 of the electric component box 50 is a part arranged on the upper side than the beam members 28*a* and 28*b*. FIG. 7 is a schematic sectional view of the electric component box corresponding to a position of arrow VII-VII of FIG. 4. The planar shape of the upper portion 51 of the electric component box 50 is formed into a substantially trapezoid shape. Specifically, the upper portion 51 has a first front surface plate 51*a* in substantially parallel to a front surface 5*a* of the outdoor unit main body 5, a first back surface plate 51*b* arranged behind and in substantially parallel to the first front surface plate 51*a*, a first left side surface plate 51*c* connecting left end portions of the first front surface plate 51*a* and the first back surface plate 51*b*, the first left side surface plate 51*c* being arranged in substantially parallel to a left side surface 5*b* of the outdoor unit main body 5, and a first right side surface plate 51*d* connecting right end portions of the first front surface plate 51*a* and the first back surface plate 51*b*, the first right side surface plate 51*d* being arranged in such a manner that a rear side part thereof is inclined leftward. Hereinafter, the rear side inclined part of the first right side surface plate 51*d* will be called as a right inclined portion 51*d*1.

In the upper portion 51 of the electric component box 50, the control board (operation board) 41 is arranged in the vicinity of the rear side of the first front surface plate 51*a*, and the reactor 44 is arranged in the vicinity of the front side of the first back surface plate 51*b*. An operation window 51*a*1 is formed in the first front surface plate 51*a*. Operation portions such as switches for performing various setting of the outdoor unit, trial operation, and the like, an LED to be lit at the abnormal time and the like are provided in the control board 41. The operation portions on the control board 41 can be operated and the LED or the like can be confirmed from this operation window 51*a*1. By arranging the control board 41 in the upper portion 51 of the electric component box 50, operation of the operation portions and confirmation of the LED or the like can be easily performed at a standing posture via the operation window 51*a*1. It should be noted that the operation window 51*a*1 is closed by a lid plate 51*a*2 capable of opening and closing. A first intake port 56 for taking the air into the electric component box 50 is formed in the first back surface plate 51*b*. The reactor 44 is a high heat generating part to be mainly cooled down by the air taken in from the first intake port 56.

As shown in FIG. 5, the upper portion 51 of the electric component box 50 is arranged adjacently to the bell mouth 30. The bell mouth 30 includes the ventilating guide 30*a*, and an outer circumferential member 30*b* arranged on the horizontally outer side of this ventilating guide 30*a* and supported by the beam members 28*a* to 28*d*. The ventilating guide 30*a* is formed into a cylindrical shape so as to surround the entire circumference of the fan 23, whereas the outer circumferential member 30*b* is formed into a substantially square shape in a plan view, and a cutout 30*c* is formed in an arrangement point of the electric component box 50.

Figure 8:
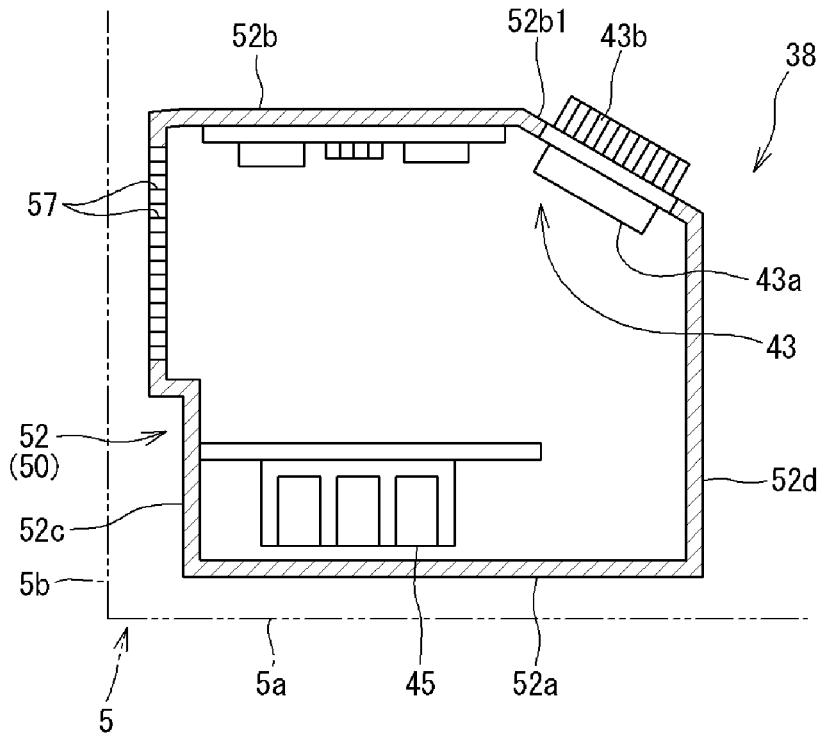
FIG. 8 is a schematic sectional view of the electric component box corresponding to a position of arrow VIII-VIII in FIG. 4.

As shown in FIG. 4, the intermediate portion 52 of the electric component box 50 is arranged on the lower side than the beam members 28*a* and 28*b*. FIG. 8 is a schematic sectional view of the electric component box corresponding to a position of arrow VIII-VIII in FIG. 4. The intermediate portion 52 is formed into a substantially square shape in a plan view. Specifically, the intermediate portion 52 has a second front surface plate 52*a* in substantially parallel to the front surface 5*a* of the outdoor unit main body 5, a second back surface plate 52*b* arranged behind the second front surface plate 52*a*, the second back surface plate 52*b* being arranged in such a manner that a right side part thereof is inclined forward, a second left side surface plate 52*c* connecting left end portions of the second front surface plate 52*a* and the second back surface plate 52*b*, the second left side surface plate 52*c* being arranged in substantially parallel to the left side surface 5*b* of the outdoor unit main body 5, and a second right side surface plate 52*d* connecting right end portions of the second front surface plate 52*a* and the second back surface plate 52*b*.

It should be noted that hereinafter, the right side inclined part of the second back surface plate 52*b* will be called as a rear inclined portion 52*b*1.

The second front surface plate 52*a* is made of the same plate member as the first front surface plate 51*a* (refer to FIG. 7), and integrally continued on the lower side of the first front surface plate 51*a*. The second left side surface plate 52*c* is made of the same plate member as the first left side surface plate 51*c*, and integrally continued on the lower side of the first left side surface plate 51*c*. A part of the second left side surface plate 52*c* slightly expands leftward. A discharge port 57 for discharging the air in the electric component box 50 is formed in this expanding part. In the intermediate portion 52 of this electric component box 50, the terminal base 45 is arranged in the vicinity of the rear side of the second front surface plate 52*a*, and the drive board 43 for the fan 23 is arranged on the front side of the second back surface plate 52*b*. In particular, a fan driver 43*a* including a switching element is provided in the drive board 43. This fan driver 43*a* is air-cooled via a heat sink 43*b* protruding outward from the rear inclined portion 52*b*1 of the second back surface plate 52*b*.

Figure 9:
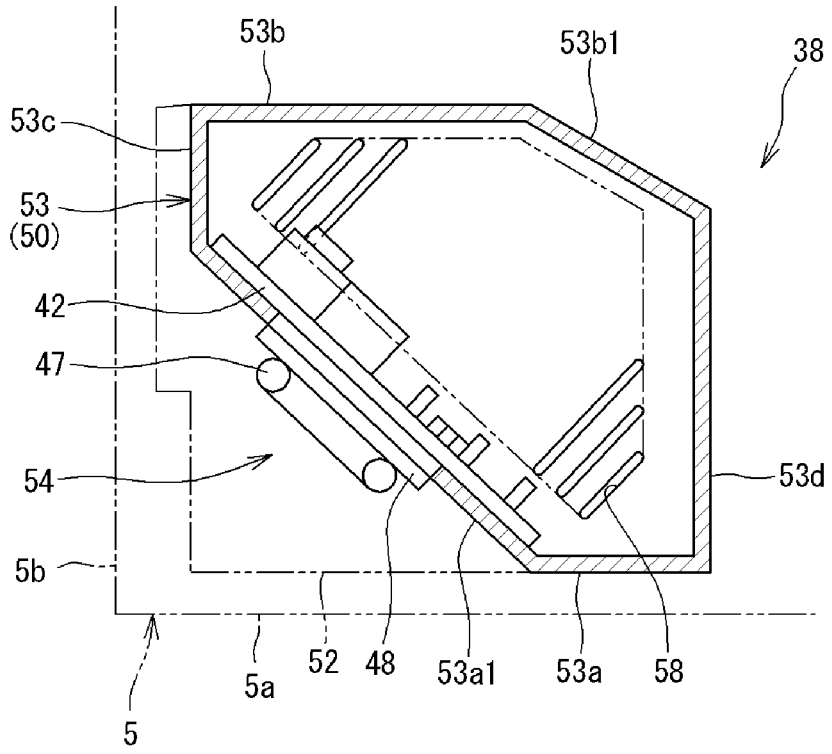
FIG. 9 is a schematic sectional view of the electric component box corresponding to a position of arrow IX-IX in FIG. 4.

As shown in FIG. 4, the lower portion 53 of the electric component box 50 is provided on the lower side of the intermediate portion 52. FIG. 9 is a schematic sectional view of the electric component box corresponding to a position of arrow IX-IX in FIG. 4. The lower portion 53 has a third back surface plate 53*b* and a third right side surface plate 53*d* formed by extending the second back surface plate 52*b* and the second right side surface plate 52*d* described above downward straightaway. The lower portion 53 of the electric component box 50 also has a third front surface plate 53*a* arranged in such a manner that a right side part thereof is substantially along the front surface 5*a* of the outdoor unit main body 5 and a left side part thereof is inclined rearward. Hereinafter, the inclined part of the third front surface plate 53*a* will be called as a front inclined portion 53*a*1. This front inclined portion 53*a*1 is arranged in substantially parallel to the right inclined portion 51*d*1 shown in FIG. 7.

Inside the lower portion 53 of the electric component box 50, the drive board 42 of the compressor 11 is arranged in the vicinity of the rear side of the front inclined portion 53*a*1 in the third front surface plate 53*a*. A cooling jacket 48 is provided on a surface of the front inclined portion 53*a*1, and a cooling refrigerant pipe 47 brought from the refrigerant pipe of the refrigerant circuit 10 (refer to FIG. 1) is in contact with this cooling jacket 48. A power module having a power element (switching element) such as an IGBT serving as a high heat generating part is mounted in the drive board 42 of the compressor 11. This power module is cooled down by the refrigerant flowing through the cooling refrigerant pipe 47. A second intake port 58 for taking the air into the electric component box 50 is formed in a bottom wall of the lower portion 53 of the electric component box 50.

Figure 10:
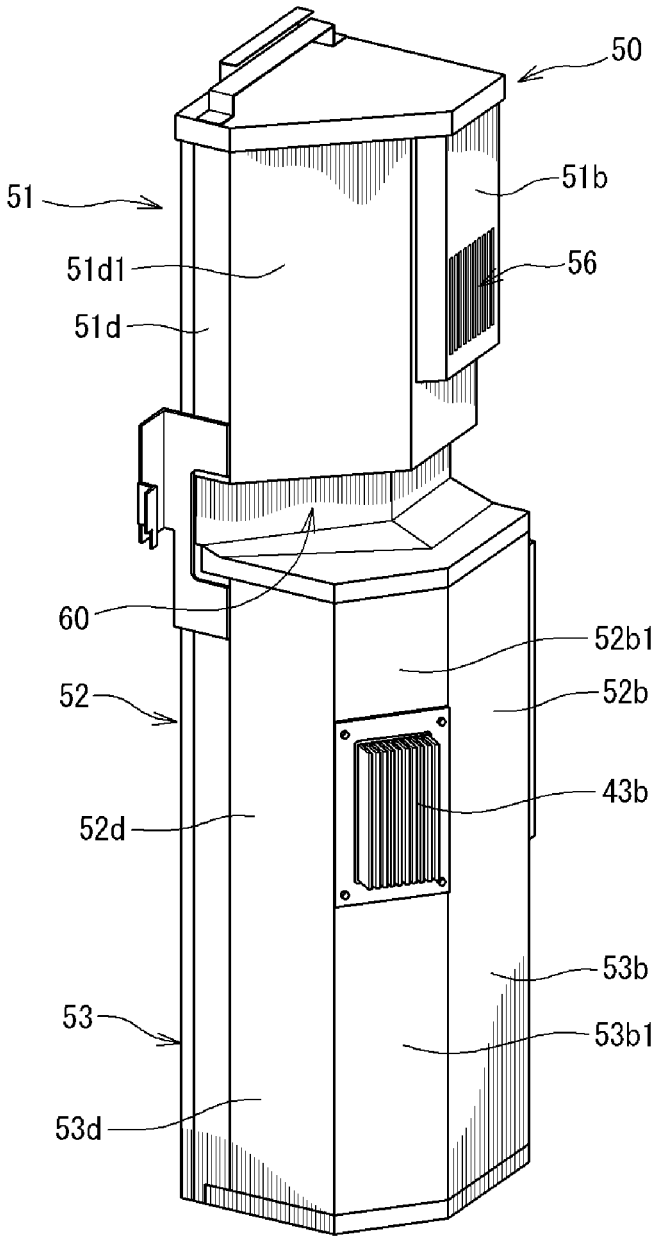
FIG. 10 is a perspective view in which an electric component unit is seen from the obliquely rear upper side.
Figure 11:
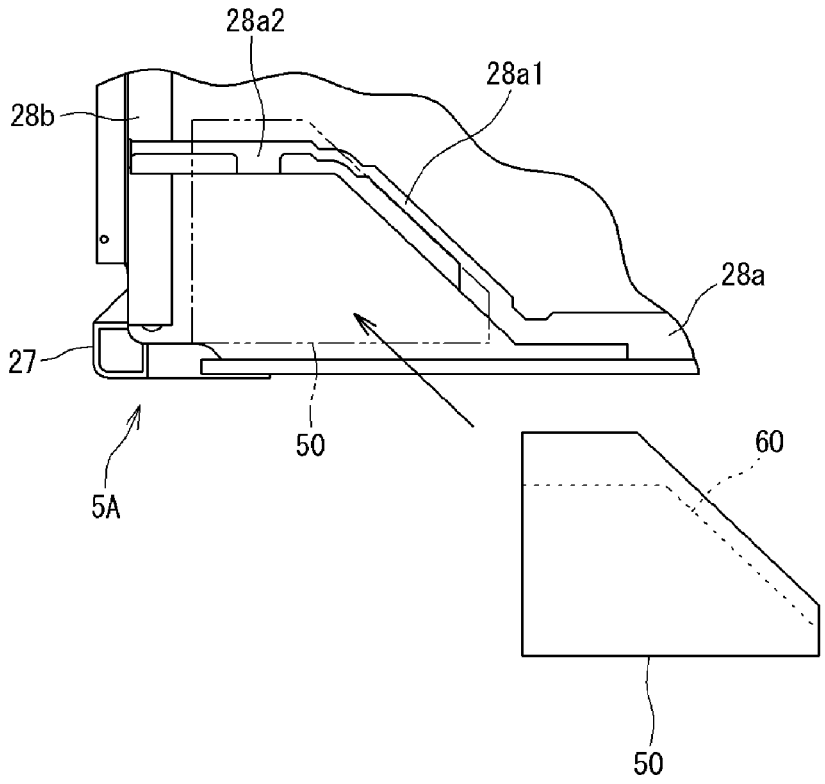
FIG. 11 is an illustrative plan view showing a process of attaching the electric component unit to an outdoor unit main body.

FIG. 10 is a perspective view in which the electric component box is seen from the obliquely rear upper side. In a border between the upper portion 51 and the intermediate portion 52 on the rear part side of the electric component box 50, a recess shape fitting groove 60 is formed in substantially parallel to the right inclined portion 51*d*1 of the first right side surface plate 51*d* and the first back surface plate 51*b*. Meanwhile, as shown in FIG. 11, a left end portion of the beam member 28*a* arranged in a front part of the outdoor unit main body 5 is recessed rearward. Specifically, an inclined portion 28*a*1 inclined rearward following a shape of the fitting groove 60, and a parallel portion 28*a*2 extending in substantially parallel to the front surface 5*a* of the outdoor unit main body 5 from a left end portion of this inclined portion 28*a*1 are formed in the left end portion of the beam member 28*a*.

When the electric component box 50 is attached to the outdoor unit main body 5, the inclined portion 28*a*1 of the beam member 28*a* is inserted obliquely left-rearward as shown by an arrow while being fitted to the fitting groove 60. Thereby, the inclined portion 28*a*1 functions as a guide rail for guiding the electric component box 50 to a predetermined attachment point. By providing such an inclined portion (guide rail portion) 28*a*1, the electric component box 50 can be readily and promptly positioned at a proper point.

By providing the inclined portion (guide rail portion) 28*a*1 in the beam member 28*a*, the electric component box 50 can be attached without butting with the cooling refrigerant pipe 47 (refer to FIG. 9). At the time of attaching the electric component box 50 to the outdoor unit main body 5, the refrigerant pipe including the cooling refrigerant pipe 47 is already assembled to the outdoor unit main body 5. Thus, there is a need for attaching the electric component box 50 without butting with the cooling refrigerant pipe 47. In the present embodiment, since the cooling refrigerant pipe 47 is provided in the front inclined portion 53*a*1 in the lower portion 53 of the electric component box 50, the electric component box 50 cannot be attached rearward straightaway from a front surface of the outdoor unit main body 5. Therefore, the guide rail portion 28*a*1 in substantially parallel to the front inclined portion 53*a*1 to which this cooling refrigerant pipe 47 is installed is formed in the beam member 28*a*, and the electric component box 50 is attached along this guide rail portion 28*a*1. Thereby, the electric component box 50 is prevented from butting with the cooling refrigerant pipe 47.

The cooling refrigerant pipe 47 is arranged in a planar range of the electric component box 50 in a plan view. That is, in the lower portion 53 of the electric component box 50, the front inclined portion 53*a*1 of the third front surface plate 53*a* is set back from the first and second front surface plates 51*a* and 52*a*. Thereby, a recess portion (arrangement recess portion) 54 in a mode where the bottom wall is recessed upward is formed in the electric component box 50. The cooling refrigerant pipe 47 is arranged in the recess portion 54 so as to be arranged in the planar range of the electric component box 50. Therefore, the cooling refrigerant pipe 47 does not protrude sideways from the electric component box 50, so that a planar arrangement space of the electric component box 50 including the cooling refrigerant pipe 47 can be reduced as far as possible.

As shown in FIG. 4, an electric wire 62 in the electric component box 50 is pulled out downward from a bottom wall (bottom wall of the intermediate portion 52) 54*a* of the electric component box 50 in the recess portion 54. Therefore, the electric wire 62 can be pulled out to the exterior without passing through the lower portion 53 of the electric component box 50 in which the drive board 42 of the compressor 11 is accommodated, so that an influence on the electric wire 62 by noises generated from the drive board 42 can be reduced.

Figure 12:
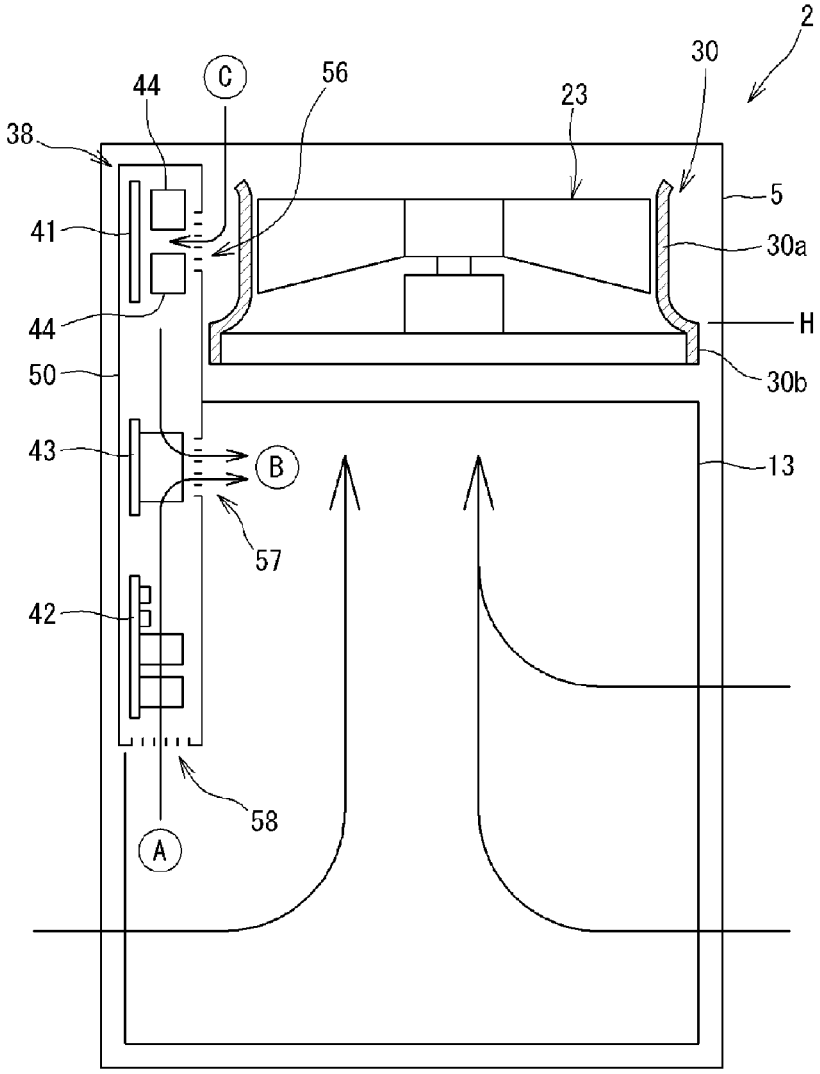
FIG. 12 is an illustrative view showing a flow of the air in the interior of the outdoor unit.

FIG. 12 is an illustrative view showing a flow of the air in the electric component box.

When the fan 23 is actuated, the external air is suctioned from the side surfaces of the outdoor unit main body 5. After the heat exchange is performed with the outdoor heat exchanger 13, the air is blown out upward. At this time, in an interior of the outdoor unit main body 5, pressure becomes negative pressure by actuation of the fan 23. In particular, since a B part shown in FIG. 12 is closer to the fan 23 than an A part, the pressure is lower. In an exterior of the outdoor unit main body 5 and a C part on the outer side of the ventilating guide 30*a* of the bell mouth 30, the pressure becomes positive pressure or atmospheric pressure.

As described above, the first intake port 56 is formed on the side surface of the upper portion 51 of the electric component box 50, the second intake port 58 is formed on the bottom surface of the lower portion 53, and the discharge port 57 is formed on the side surface of the intermediate portion 52. By differential pressure between the C part and the B part as described above, the air is taken into the electric component box 50 from the first intake port 56 and discharged from the discharge port 57. By this flow of the air, the devices on the upper part side of the electric component box 50 are cooled down. By differential pressure between the A part and the B part, the air is taken into the electric component box 50 from the second intake port and discharged from the discharge port 57. By this flow of the air, the devices on the lower part side of the electric component box 50 are cooled down.

The differential pressure between the A part and the B part is smaller than the differential pressure between the C part and the B part. Thus, the flow of the air from the second intake port 58 to the discharge port 57 is weaker than the flow of the air from the first intake port 56 to the discharge port 57. However, by the relatively strong flow of the air from the first intake port 56 to the discharge port 57, a flow of the air from the first intake port 56 to the discharge port 57 is caused, and inflow of the air from the second intake port 58 is facilitated. By such an action, a heat release property of the electric component box 50 can be more enhanced.

In the above embodiment, the outdoor heat exchanger 13 is arranged so as to face the four side surfaces of the outdoor unit main body 5 (refer to FIG. 6). Therefore, in comparison to a case where the outdoor heat exchanger 13 is arranged so as to face three side surfaces of the outdoor unit main body 5, a circulation area of the air can be extended, so that a heat exchange ability can be enhanced. In other words, since the outdoor heat exchanger 13 is arranged so as to face the four side surfaces of the outdoor unit main body 5, the circulation area of the air can be maintained even with reduced size of the outdoor unit main body 5. Therefore, the outdoor unit main body 5 can be downsized without lowering the ability of the outdoor heat exchanger 13.

However, when the outdoor heat exchanger 13 is arranged on the four side surfaces of the outdoor unit main body 5, the opening portion 36 formed between the one side end portion 32*a* and the other side end portion 35*a* of the outdoor heat exchanger 13 is reduced, and a ratio of the arrangement space of the electric component box 50 in this opening portion 36 is relatively increased. Therefore, in a case where a work such as maintenance and replacement of the devices in the outdoor unit main body 5 is performed by utilizing the remaining space of the opening portion 36, there is a possibility that workability is deteriorated.

Regarding this point, in the outdoor unit 2 of the present embodiment, the electric component box 50 is arranged so as to cross over a lower end (denoted by a reference sign H in FIG. 12) of the ventilating guide 30*a* in the up and down direction. Thus, in comparison to a case where the entire electric component box 50 is arranged on the lower side than the lower end H of the ventilating guide 30*a*, the arrangement space of the electric component box 50 in the opening portion 36 can be reduced. Therefore, the remaining space of the opening portion 36 excluding the arrangement space of the electric component box 50 can be ensured as widely as possible, so that the work such as the maintenance of the devices in the outdoor unit main body 5 can be easily performed by utilizing the opening portion 36.

A region on the upper side than the lower end H of the ventilating guide 30*a* and on the horizontally outer side than the ventilating guide 30*a* hardly contributes to the flow of the air in the outdoor unit main body 5. Therefore, even when a part of the electric component box 50 is arranged in this region, the flow of the air in the outdoor unit main body 5 is hardly harmfully influenced and heat exchange efficiency is not deteriorated.

As shown in FIG. 3 and FIG. 4, the electric component unit 38 is arranged in the left front corner portion 5A in the outdoor unit main body 5. Meanwhile, as shown in FIG. 5, the fan 23 is arranged so as to be displaced to other corner portions where the electric component unit 38 is not arranged, specifically to the side of the right front and right rear corner portions of the outdoor unit main body 5. Therefore, a relatively wide space for arranging the electric component unit 38 can be formed on the left front side of the outdoor unit main body 5. As shown in FIG. 5 and FIG. 6, in the outdoor heat exchanger 13, the circulation area of the air is larger on the left side of the outdoor unit main body 5 than the right side, whereas the fan 23 is arranged so as to be displaced to the right side of the outdoor unit main body 5. Therefore, the air can be suctioned more from the right side of the outdoor unit main body 5, so that the heat exchange can be more efficiently performed by the outdoor heat exchanger 13.

The present invention is not limited to the above embodiment but can be appropriately changed within the scope of the invention described in the claims.

For example, the present invention can be applied to an outdoor unit 2 including an outdoor heat exchanger 13 arranged in a U shape along three side surfaces of an outdoor unit main body 5. However, more effectively, the present invention is applied to the outdoor unit 2 in which the outdoor heat exchanger 13 is arranged so as to face the four side surfaces of the outdoor unit main body 5 as in the above embodiment.

Although the outdoor unit 2 of the above embodiment includes one compressor 11, two or more compressors 11 may be provided. Even in this case, the opening width W of the front opening portion 36A is such width that one compressor 11 can be taken in and out, so that a plurality of compressors 11 can be taken in and out from the front opening portion 36A one by one in order.

REFERENCE SIGNS LIST

1: AIR CONDITIONING DEVICE
2: OUTDOOR UNIT
5: OUTDOOR UNIT MAIN BODY
11: COMPRESSOR
13: OUTDOOR HEAT EXCHANGER
23: FAN
28*a:* BEAM MEMBER (ATTACHMENT MEMBER)
28*a*1: INCLINED PORTION (GUIDE RAIL PORTION)
30: BELL MOUTH
30*a:* VENTILATING GUIDE (VENTILATING MEMBER)
32*a:* ONE SIDE END PORTION OF HEAT EXCHANGER
35*a:* OTHER SIDE END PORTION OF HEAT EXCHANGER
38: ELECTRIC COMPONENT UNIT
42: DRIVE BOARD (HIGH HEAT GENERATING PART)
50: ELECTRIC COMPONENT BOX
54: ARRANGEMENT RECESS PORTION
54*a:* BOTTOM WALL
56: FIRST INTAKE PORT
57: DISCHARGE PORT
58: SECOND INTAKE PORT

The invention claimed is:

1. An outdoor unit for an air conditioning device, comprising:

an outdoor unit main body;

a heat exchanger accommodated in the outdoor unit main body, the heat exchanger having a first horizontal end portion and a second horizontal end portion separated by an open space;

a fan provided in an upper part of the outdoor unit main body, the fan blowing out air taken in from side surfaces of the outdoor unit main body;

a ventilating member, having an upper end and a lower end, surrounding an outer circumference of the fan and forming a blow-out port of the air at a top of the upper part of the outdoor unit main body; and an electric component unit accommodated in the outdoor unit main body and arranged in the open space between the first horizontal end portion and the second horizontal end portion of the heat exchanger, wherein the electric component unit extends vertically across the lower end of the ventilating member, a part of the electric component unit is arranged vertically higher than the lower end of the ventilating member and is arranged horizontally outside of an outer edge of the ventilating member, the electric component unit includes an electric component box for accommodating an electric component, and the electric component box includes a first intake port for taking the air into the electric component box formed vertically higher than the lower end of the ventilating member, and a discharge port for discharging the air in the electric component box formed vertically lower than the lower end of the ventilating member.

2. The outdoor unit for the air conditioning device according to claim 1, wherein the electric component box further includes a second intake port for taking the air into the electric component box formed vertically lower than the discharge port in a lower portion of the electric component box.

3. The outdoor unit for the air conditioning device according to claim 2, wherein a high heat generating part is arranged in the lower portion of the electric component box.

4. The outdoor unit for the air conditioning device according to claim 3, wherein the electric component box further includes an arrangement recess portion for arranging a cooling refrigerant pipe for cooling down the high heat generating part in the planar range of the electric component box formed in the lower portion of the electric component box.

5. The outdoor unit for the air conditioning device according to claim 4, wherein the arrangement recess portion is formed by recessing a part of a bottom wall of the electric component box upward, and an electric wire in the electric component box is pulled out to an exterior from a bottom wall in the arrangement recess portion.

6. The outdoor unit for the air conditioning device according to claim 2, wherein the second intake port is formed on a bottom vertical face of the electric component box.

* * * * *